US009903678B2

(12) United States Patent
Sherrill

(10) Patent No.: US 9,903,678 B2
(45) Date of Patent: Feb. 27, 2018

(54) METHOD OF MANUFACTURING A DIFFUSER MUZZLE BRAKE

(71) Applicant: John Sherrill, Lubbock, TX (US)

(72) Inventor: John Sherrill, Lubbock, TX (US)

( * ) Notice: Subject to any disclaimer, the term of this patent is extended or adjusted under 35 U.S.C. 154(b) by 0 days.

(21) Appl. No.: 15/246,593

(22) Filed: Aug. 25, 2016

(65) Prior Publication Data

US 2017/0059268 A1 Mar. 2, 2017

Related U.S. Application Data

(60) Provisional application No. 62/210,147, filed on Aug. 26, 2015.

(51) Int. Cl.
*F41A 21/36* (2006.01)

(52) U.S. Cl.
CPC ..... *F41A 21/36* (2013.01)

(58) Field of Classification Search
CPC ..... F41A 21/34; F41A 21/36; F41A 21/38
See application file for complete search history.

(56) References Cited

U.S. PATENT DOCUMENTS

| | | | | |
|---|---|---|---|---|
| 2,212,685 | A * | 8/1940 | Hughes | F41A 21/36 89/14.3 |
| 4,893,544 | A * | 1/1990 | Hawley | F41A 21/34 89/14.2 |
| 4,945,812 | A * | 8/1990 | Mazzanti | F41A 21/36 89/14.3 |
| 5,675,107 | A * | 10/1997 | Ledys | F41A 21/36 89/14.05 |
| 6,158,679 | A * | 12/2000 | Ohmi | G05D 7/0186 239/589 |
| 9,228,789 | B1 * | 1/2016 | Oglesby | F41A 21/36 |
| 9,417,024 | B2 * | 8/2016 | Miller, III | F41A 21/36 |
| 9,593,900 | B2 * | 3/2017 | Vossler | F41A 21/34 |

OTHER PUBLICATIONS

"Making a muzzle brake", Apr. 21, 2006, the-long-family.com.*

* cited by examiner

*Primary Examiner* — Stephen Johnson
*Assistant Examiner* — Joshua T Semick
(74) *Attorney, Agent, or Firm* — Sheri Higgins Law; Sheri Higgins

(57) ABSTRACT

A system and method for a diffuser muzzle brake. The exhaust ports are upstream of the reaction plate. This allows the deflection and redirection of exhaust gases to reduce recoil. The internal cylinder bore and exhaust ports are manufactured with cost saving methods. The muzzle brake has at least one radial exhaust port pattern. The muzzle brake has at least one longitudinal exhaust port pattern. The muzzle brake has at least one downstream reaction plate.

17 Claims, 6 Drawing Sheets

METHOD OF MANUFACTURING A DIFFUSER MUZZLE BRAKE

CROSS-REFERENCE TO RELATED APPLICATIONS

This application is a continuation of and claims priority to U.S. Provisional Application No. 62/210,147, filed Aug. 26, 2015.

TECHNICAL FIELD

A muzzle brake, or recoil compensator, can be used to counter recoil and unwanted rising of a barrel of a firearm during firing. A muzzle brake can be connected to the muzzle of a firearm.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION OF THE INVENTION

It is to be understood that the relative terms, "top," "bottom," "front," "back," and "sides" are used to describe the drawings and various parts to aid the reader in understanding the various embodiments.

Muzzle brakes or recoil compensators are devices that are connected to the muzzle of a firearm to redirect gas flow out of exhaust ports on the muzzle brake that functions to counteract recoil and unwanted rising of the barrel during firing. Generally, muzzle brakes are manufactured in multiple stages using multiple techniques and steps, which results in an increased manufacturing cost. Moreover, most exhaust ports are cylindrical in shape thereby decreasing the volume of gas that can be redirected out of the exhaust ports. As such, there is a need for improved exhaust ports and methods of manufacturing a muzzle brake.

It has been discovered that using of a standard center drill to create exhaust ports and a thread relief cylinder bore to create an internal diameter results in a cost-effective method of manufacture. Additionally, the exhaust ports created with the center drill enhance gas flow out of the ports and greatly increase muzzle brake effectiveness.

Figure 1A:
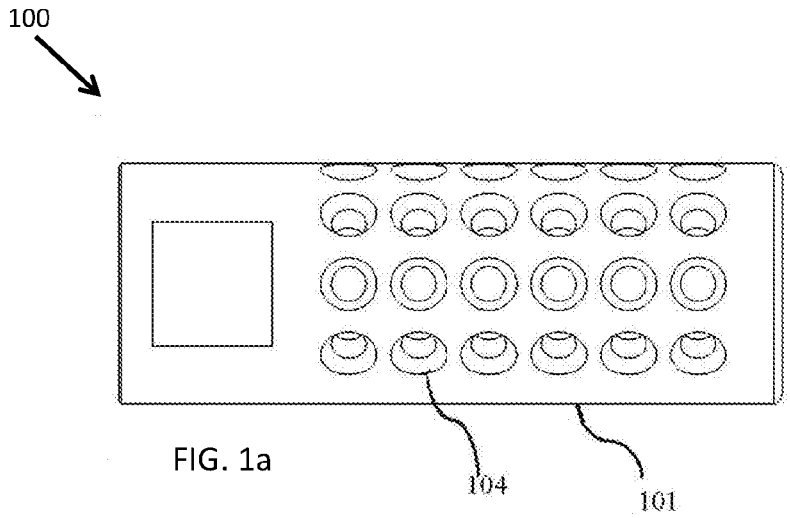
FIG. 1*a* is a side view of a muzzle device according to certain embodiments.

FIG. 1*a* shows a muzzle brake 100 according to certain embodiments. The muzzle brake 100 can include a body 101. The body 101 can be generally cylindrical in shape and include a first end and a second end. The body 101 can form an outer diameter (OD) of the muzzle brake 100. The body 101 can be made from a variety of materials, including, but not limited to, a ferrous metal, a non-ferrous metal, a carbon based material, a ceramic material, a composite material, and combinations thereof. The body 101 can also be treated with any surface treatment that may enhance the strength, corrosion resistance, wear resistance, erosion resistance, and fatigue strength of the body 101. The body 101 may also be treated to reduce thermal signature or treated for coloring and/or identification. The muzzle brake 100 includes one or more exhaust ports 104.

The length and OD of the body 101 can vary based on the desired use, for example, the bullet caliber. According to certain embodiments, the length of the body 101 ranges from about 1.75 inches (in.) (4.4 centimeters (cm)) to about 4 in. (10.2 cm). The OD can range from about 0.75 in. (1.9 cm) to about 3 in. (7.6 cm). It should be understood that larger or smaller calibers may require larger or smaller dimensions.

Figure 1B:
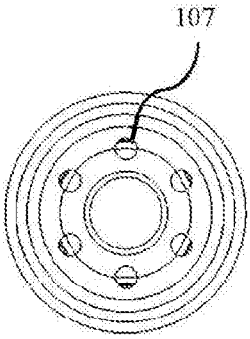
FIG. 1*b* is a front cross-sectional view of the muzzle device of FIG. 1.

FIG. 1*b* is a cross-sectional front view of the muzzle brake 100 according to certain embodiments. According to these embodiments, the muzzle brake 100 can include one or more drain holes 107 for allowing a liquid to drain from the muzzle brake 100. The drain holes 107 can vary in number and arrangement in the muzzle brake 100 and can be selected based on the anticipated volume of liquid needing to be expelled from the muzzle brake 100.

Figure 2:
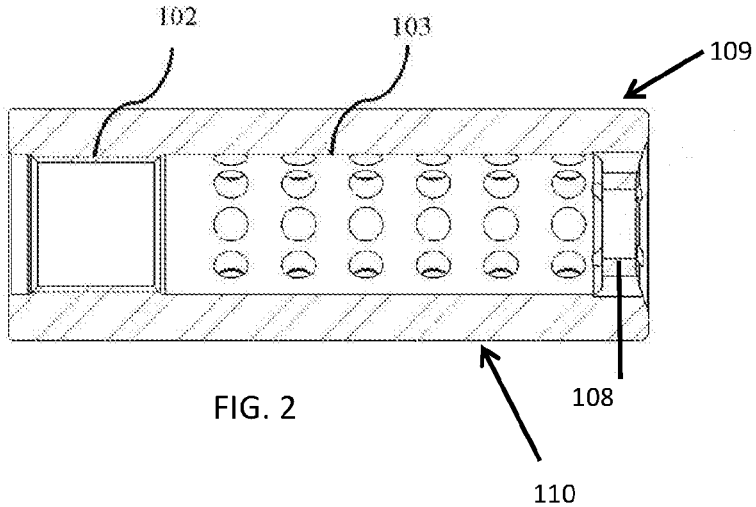
FIG. 2 is a side cross-sectional view of a muzzle device according to certain embodiments.

As can be seen in FIG. 2, the muzzle brake 100 can include a device coupler 102. The device coupler 102 couples the muzzle brake 100 to a firearm. The muzzle brake 100 can be coupled by any method or device known in the art including screwing the device coupler 102, bolts, a threaded barrel muzzle, a pinch bolt clamp, screws, etc. As can be seen, according to certain embodiments, the device coupler 102 is located at a first end of the muzzle brake upstream from a second end of the muzzle brake 100. As used herein, "upstream" means at a location closer to the barrel of the gun and "downstream" means at a location further away from the barrel.

The muzzle brake 100 can also include a central bore 103. The central bore 103 can be generally cylindrical in shape and make up an inner diameter (ID) of the muzzle brake 100. The central bore 103 can be a thread relief bore. The muzzle brake 100 can also include a projectile exit 108 wherein a projectile can exit the muzzle brake 100. The muzzle brake 100 can also include a top portion 109 that is oriented at the top of the muzzle brake 100 in relation to the barrel of a firearm and a bottom portion 110 that is oriented at the bottom of the muzzle brake 100 in relation to the barrel of a firearm.

Figure 3:
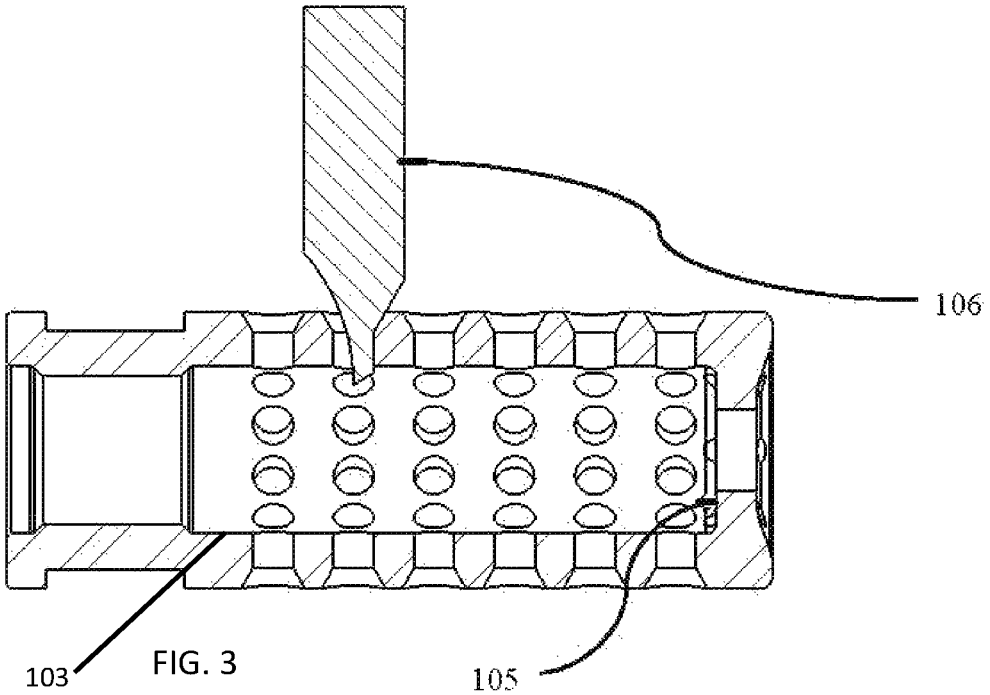
FIG. 3 is a side cross-sectional view of the muzzle device showing a center drill for creating exhaust ports.
Figure 4:
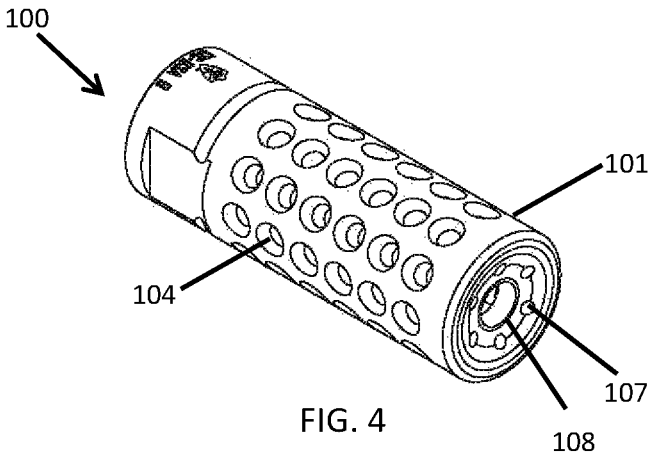
FIG. 4 is a top, front perspective view of the muzzle device according to certain embodiments.
Figure 5:
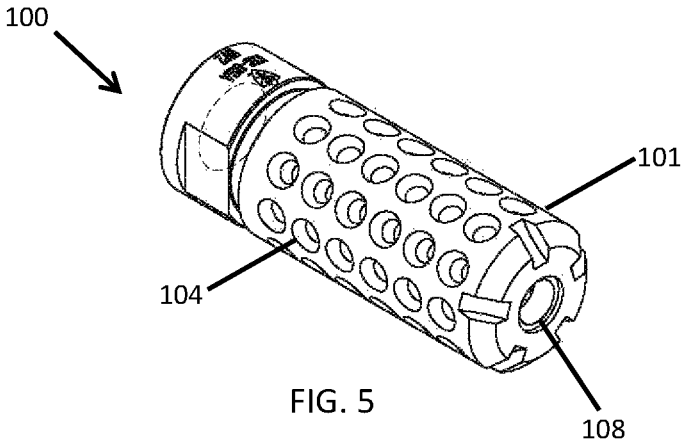
FIG. 5 is a top, front perspective view of the muzzle device according to certain other embodiments.
Figure 6A:
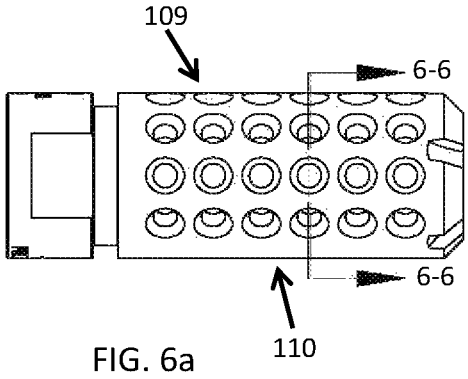
FIG. 6*a* is a side view of the muzzle device of FIG. 5.
Figure 6B:
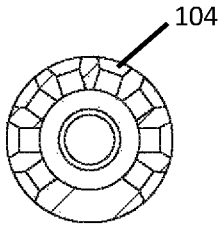
FIG. 6*b* is a front cross-sectional view of the muzzle device of FIG. 6*a* taken along lines 6-6.
Figure 7A:
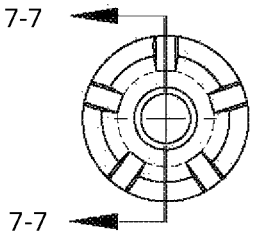
FIG. 7*a* is a front cross-sectional view of the muzzle device according to certain other embodiments.
Figure 7B:
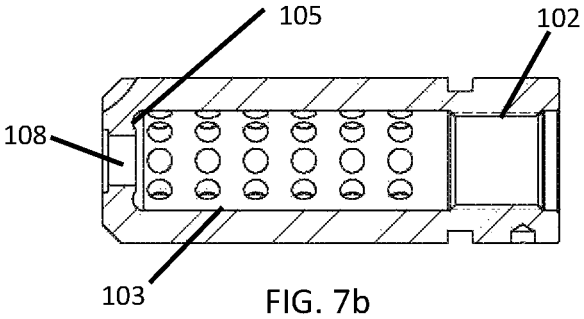
FIG. 7*b* is a side cross-sectional view of the muzzle device of FIG. 7*a* taken along lines 7-7.
Figure 8:
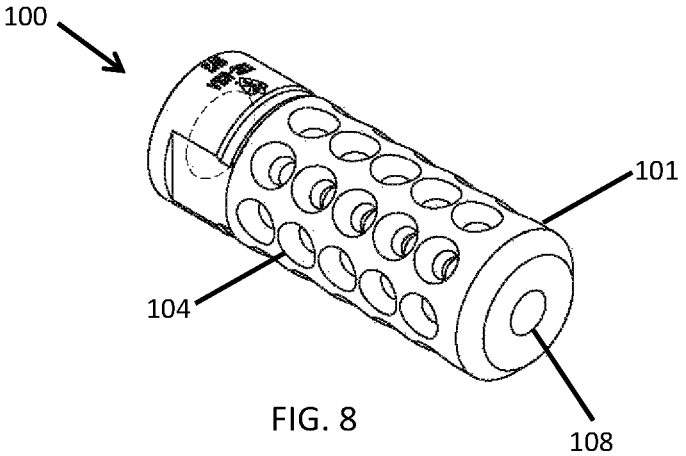
FIG. 8 is a top, front perspective view of the muzzle device according to certain other embodiments.
Figure 9A:
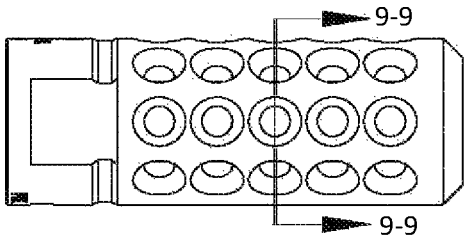
FIG. 9*a* is a side view of the muzzle device of FIG. 8.
Figure 9B:
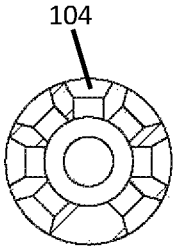
FIG. 9*b* is a front cross-sectional view of the muzzle device of FIG. 9*a* taken along lines 9-9.
Figure 10A:
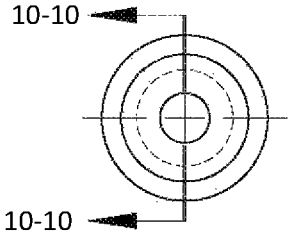
FIG. 10*a* is a front cross-sectional view of the muzzle device according to certain other embodiments.
Figure 10B:
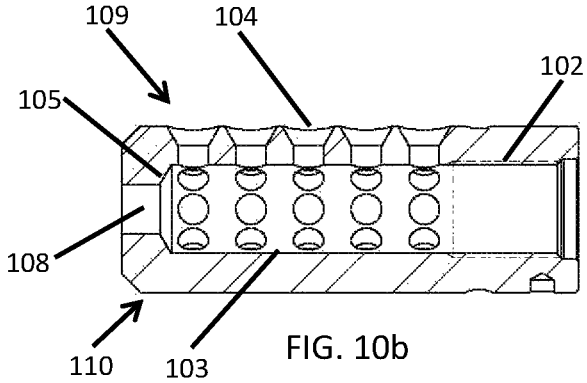
FIG. 10*b* is a side cross-sectional view of the muzzle device of FIG. 10*a* taken along lines 10-10.

As can be seen in FIG. 3, the muzzle brake 100 can include a reaction plate 105. The reaction plate 105 can be located at the second end of the muzzle brake 100, downstream of the device coupler 102. The reaction plate 105 can be oriented approximately perpendicular to the length of a barrel of a firearm. The reaction plate 105 can redirect the flow of gases from the second end of the muzzle brake 100 and toward the exhaust ports 104. The reaction plate 105 can include an exit 108 for allowing a projectile to exit the muzzle brake 100. The size of the projectile exit 108 will depend upon the caliber of the bullet. The reaction plate 105 of FIG. 3 includes generally flat surface faces.

The exhaust ports 104 are created using a center drill 106. The center drill 106 includes a large diameter body, an included angle (e.g., a 60° included angle), and a tapered head. The center drill 106 creates exhaust ports 104 having a cylindrical-shaped portion and a conical-shaped portion. The cylindrical-shaped portion is located at and near the central bore 103, while the conical-shaped portion is located at and near the OD of the body 101. Thus, each exhaust port 104 has an exit diameter that is greater than the inlet diameter. The center drill 106 is positioned on the outside of the body 101 and penetrates through the thickness of the body and into the central bore 103 to create the exhaust ports 104. As a result, gases can be redirected from the central bore 103, through the exhaust ports 104, to the outside of the body 101.

FIGS. 5-7*b* show a muzzle brake 100 according to certain other embodiments. As can be seen, the muzzle brake 100 according to these other embodiments, includes a radiused reaction plate 105, a conical-shaped second end of the body 101, a deeper radial cut by wrench flats to allow for attachment of various accessories, and aesthetic cuts on the second end.

FIGS. 8-10*b* show a muzzle brake 100 according to certain other embodiments. As can be seen, the muzzle brake 100 according to these other embodiments, has a smaller central bore 103, a conical-shaped reaction plate 105 formed with a standard drill bit, and a shallow aesthetic cut by wrench flats.

The exhaust ports 104 according to any of the embodiments can be arranged radially around the body 101 and longitudinally along a longitudinal axis of the body. The number and the dimensions of the exhaust ports 104 can vary and depend on a variety of factors. The factors can include, but are not limited to, the length of the body 101, the distance between the ID and OD of the body 101, the OD of the body 101, thread size, and stress to the body 101. According to certain embodiments, the exhaust ports 104 are selected and positioned to maximize the total exhaust port 104 area relative to the area of the body 101. According to certain embodiments, the ODs of the exhaust ports 104 do not touch each other or overlap. These embodiments can be useful to reduce stress to the body 101 of the muzzle brake 100. For example, as seen in FIGS. 5-7*b,* 8 exhaust ports 104 are arranged radially around the outer circumference of the body and 6 exhaust ports 104 are arranged longitudinally along the outer circumference of the body for a total of 48 exhaust ports. By way of another example, as seen in FIGS. 8-10*b,* 7 exhaust ports 104 are arranged radially around the outer circumference of the body and 5 exhaust ports 104 are arranged longitudinally along the outer circumference of the body for a total of 35 exhaust ports.

Depending on the thickness of the body 101 between the OD and ID of the body, a larger or smaller center drill 106 may be needed to form the exhaust ports 104. For example, the larger the body thickness, the larger the center drill 106 needed to create exhaust ports that transverse the entire thickness. This results in exhaust ports 104 having a larger OD compared to exhaust ports that have been created using a smaller center drill. In this example, fewer number of exhaust ports 104 may be required to reduce or prevent stressing the body 101 beyond its stress point. One of the many advantages to using a center drill for creating the exhaust ports 104 is that the overall shape of the exhaust ports 104 means that there is a larger solid surface area on the ID of the body (where the ID of the exhaust ports is smaller) and a smaller solid surface area on the OD of the body (where the OD of the exhaust ports is larger). This can provide increased structural integrity to the muzzle brake 100 while also providing for an increased gas flow through the ports.

Exhaust ports 104 can be omitted from the top portion 109 of the body 101 to keep the exhaust plume out of the user's line of sight. In addition to, or instead of, exhaust ports 104 can also be omitted from the bottom portion 110 of the body 101 to eliminate disturbance of the ground below.

The muzzle brake 100 can also include additional features to accommodate, for example, mounting a silencer, use as a grenade launcher, a bayonet mount, and a castellated glass breaking feature on the second end or downstream end of the device. The additional features can be attached to the muzzle brake 100 via any method or device known in the art. For example, for a barrel launched rifle grenade, the muzzle brake 100 can be of such an OD and length as to accommodate the grenade. A bayonet can include a loop on the bayonet guard that mounts over the muzzle brake 100 diameter. A silencer can utilize grooves, threads, interrupted threads, lugs, timing slots, ratcheting gear/notches, and/or a conical feature for sealing, location, and retention to the muzzle brake 100.

Figure 11:
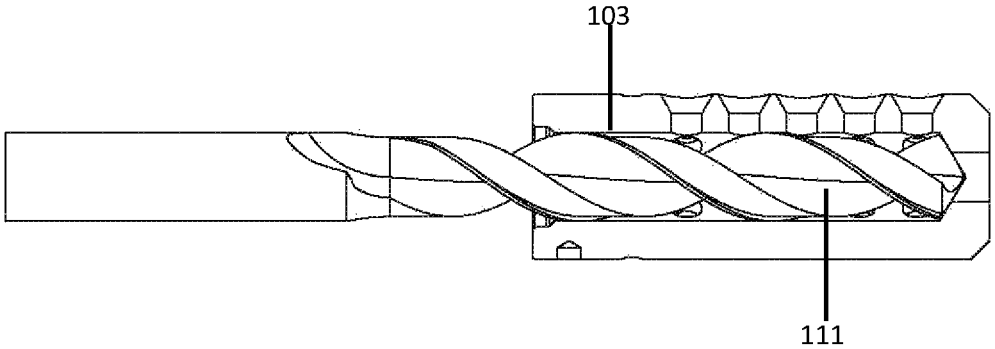
FIG. 11 is a side cross-sectional view showing a cylindrical bore created with a drill bit.

Methods of manufacturing the muzzle brake 100 can include: creating an outer diameter (OD) of a body; creating OD features; creating a central bore 103, for example, via a drill bit 111 as shown in FIG. 11; threading the muzzle brake; creating the exhaust ports 104 with the center drill 106; cutting the first and second ends of the muzzle brake 100; facing the ends of the muzzle brake off; and creating any OD features, such as applying corrosion resistant coatings. It should be understood that the use of a center drill allows the muzzle brake 100 to be manufactured at lower costs, while also providing for a more effective muzzle brake 100. Additionally, the use of a standard drill 111 further reduces the manufacturing cost of the muzzle brake.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention.

As used herein, the words "comprise," "have," "include," and all grammatical variations thereof are each intended to have an open, non-limiting meaning that does not exclude additional elements or steps. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of manufacturing a muzzle brake, the method comprising:

creating a body having an outer diameter;

creating a central bore, wherein the central bore creates an inner diameter of the body; and creating one or more exhaust ports with a center drill, wherein the one or more exhaust ports extend from the outer diameter to the inner diameter, and wherein the one or more exhaust ports comprise: a conical-shaped portion extending from the outer diameter towards the inner diameter; a cylindrical-shaped portion extending from the inner diameter towards the outer diameter; and a 60° included angle at the junction of the conical-shaped portion and the cylindrical-shaped portion.

2. The method according to claim 1, further comprising creating features on the outer diameter of the body.

3. The method according to claim 1, wherein the muzzle brake further comprises a reaction plate located at a second end of the muzzle brake, wherein the second end is located opposite of a first end, and wherein the reaction plate is oriented perpendicular to a longitudinal axis of the muzzle brake.

4. The method according to claim 1, wherein each of the one or more exhaust ports has an exit diameter that is greater than an inlet diameter.

5. The method according to claim 1, wherein the one or more exhaust ports are arranged radially around the body and longitudinally along the body.

6. The method according to claim 1, wherein the body is cylindrical in shape.

7. The method according to claim 1, wherein the central bore is cylindrical in shape.

8. The method according to claim 1, wherein the muzzle brake further comprises one or more drain holes for allowing a liquid to drain from the muzzle brake.

9. The method according to claim 1, wherein the muzzle brake further comprises a device coupler located at a first end of the muzzle brake, wherein the device coupler couples the muzzle brake to a firearm.

10. The method according to claim 9, further comprising threading the muzzle brake to couple the muzzle brake to a barrel of a firearm via the device coupler.

11. The method according to claim 1, wherein a top portion of the body does not comprise exhaust ports, or a bottom portion of the body does not comprise exhaust ports, or both the top portion and the bottom portion of the body do not comprise exhaust ports.

12. The method according to claim 1, wherein the number and the dimensions of the one or more exhaust ports are selected based on one or more factors.

13. The method according to claim 12, wherein the one or more factors are selected from the group consisting of a length of the body, a distance between the outer diameter and inner diameter of the body, the outer diameter of the body, a thread size of threads located on an end of the muzzle brake and an end of a barrel of a firearm, a stress to the body created by exhaust gasses during firing of a firearm, and combinations thereof.

14. The method according to claim 1, wherein a number, dimensions, and spacing pattern of the one or more exhaust ports are selected to maximize a total exhaust port area relative to an area of the body.

15. The method according to claim 1, wherein the one or more exhaust ports are a plurality of exhaust ports, wherein the number of the plurality of exhaust ports range from about 20 to about 60.

16. The method according to claim 1, wherein the center drill comprises a head having a bottom portion that has one angle that tapers from a first edge to a second edge of the bottom portion.

17. The method according to claim 16, wherein the head further comprises an upper portion having two sides, and wherein the two sides have different angles that are offset from one another.

* * * * *